US005586452A

United States Patent [19]

Schmid

[11] Patent Number: 5,586,452

[45] Date of Patent: Dec. 24, 1996

[54] JEWELRY WITH AN INTEGRAL HINGE

[75] Inventor: Peter Schmid, Leeds, United Kingdom

[73] Assignee: Abbeycrest Plc., Leeds, England

[21] Appl. No.: 192,303

[22] Filed: Feb. 4, 1994

Related U.S. Application Data

[63] Continuation of Ser. No. 970,377, Nov. 2, 1992, abandoned.

[30] Foreign Application Priority Data

Nov. 6, 1991 [GB] United Kingdom ..... 9123539

[51] Int. Cl.[6] ..... A44C 15/00

[52] U.S. Cl. ..... 63/19; 29/896.41

[58] Field of Search ..... 63/18, 19, 23; 29/160.6; 368/313; 16/368, 260, 267, 268

[56] References Cited

U.S. PATENT DOCUMENTS

| | | | |
|---|---|---|---|
| D. 34,811 | 7/1901 | Mackson | 63/19 |
| 718,562 | 1/1903 | Blackinton | 63/19 |
| 998,160 | 7/1911 | Daniels | 63/19 |
| 1,255,870 | 2/1918 | Foster | 63/19 |
| 1,394,877 | 10/1921 | Wood . | |
| 1,598,250 | 8/1926 | Person . | |
| 2,377,816 | 6/1945 | Slain | 63/19 |
| 2,863,307 | 12/1958 | Donle . | |
| 3,618,338 | 11/1971 | Sauer | 63/19 |

FOREIGN PATENT DOCUMENTS

| | | |
|---|---|---|
| 013338 | 7/1980 | European Pat. Off. . |
| 260048 | 3/1988 | European Pat. Off. . |
| 6527 | of 1915 | United Kingdom . |

*Primary Examiner*—Flemming Saether
*Attorney, Agent, or Firm*—Klauber & Jackson

[57] ABSTRACT

An item of jewelry, specifically a locket, is made from stamped rings or rims (36, 38) of which one has an integral pivot pin (40) and the other has a hinge tongue (52) which are formed during the stamping. To connect the rings (36, 38) the tongue 40 is simply passed behind the pin (40) and then wrapped round it. The rings (36, 38) are soldered to respective locket shells (30, 32) to complete the locket.

10 Claims, 5 Drawing Sheets

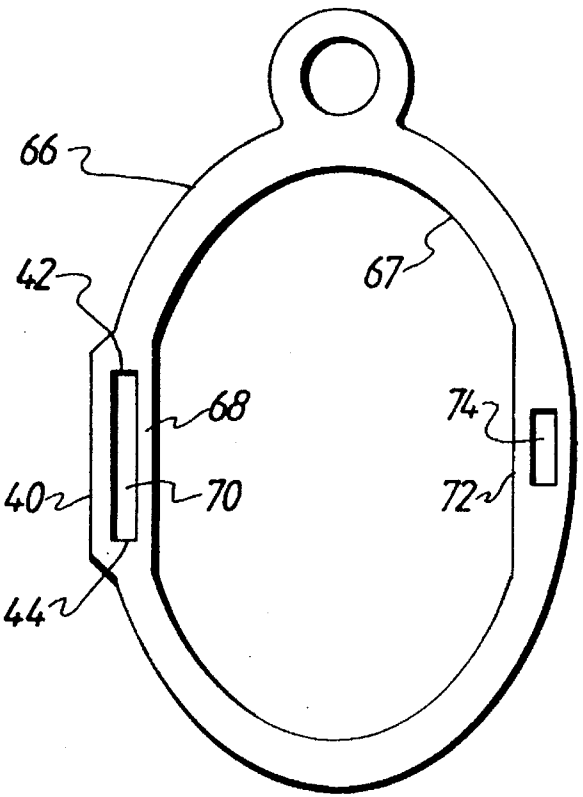
FIG.8
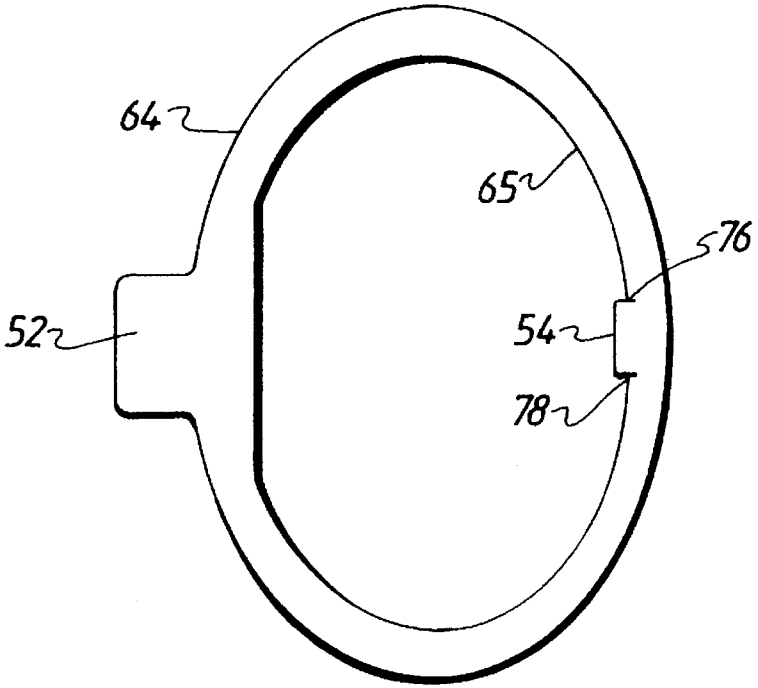

JEWELRY WITH AN INTEGRAL HINGE

This application is a continuation of application Ser. No. 07/970,377, filed Nov. 2, 1992 now abandoned.

This invention relates to items of jewelry, of a nature comprising two components which are hinged together so as to be movable between open and closed positions. A specific item to which the invention relates is what is known as a locket, which comprises two components or halves adapted to contain a keepsake or keepsakes such as photographs, locks of hair and so on, the halves being movable between closed and open positions. Lockets are usually worn around the neck, being suspended therefrom by means of a suitable jewelry chain, the locket having an attachment loop for connection of the locket to the chain.

Although the invention has particular application to lockets, it is to be mentioned that it can be applied to other items of jewelry, and included within this expression are items such as watch cases, compacts and the like.

The invention applies to items of jewelry wherein there are two endless hoops or rims which may be of any shape e.g. round, circular, triangular, heart shaped and so on and which when in the open position lie side by side and symmetrically arranged, the hinge being where the two rims touch, and when the rims are in the closed position, they lie in superimposed relationship. An item of jewelry to which the invention relates may also comprise simply a pair of rims hinged together said rims being for example adapted to contain a photograph. Lockets are of course well known and are in extensive use, and whilst lockets of the known form vary in quality depending upon the skill of the manufacturer and the material used, generally speaking the known lockets comprise a number of components which have to be connected to produce the final locket. These components comprise a pair of locket shells each of which is dished to form a receiving cavity, a pair of the said rims which are soldered to the shells, tubular hinge sleeves which are soldered to the rims and/or shells, a hinge pin which is threaded into the hinge sleeves on the respective locket halves, and a locket clasp which may be in one part or two parts soldered to the locket halves.

The manner of assembly and manufacture is expensive and time consuming, and great care must be taken if a locket of quality is to be produced. Despite the shortcomings of the known construction, lockets have been produced only in this way for many years.

The present invention aims at the provision of an item of jewelry, involving a method of production which, as applied specifically to lockets, will enable a quicker and less expensive production of lockets whilst retaining the required production quality.

In accordance with the invention, an item of jewelry comprising or including a pair of the said rims is produced by manufacturing the rims as blanks provided respectively with an integral hinge pin on the one hand and an integral hinge tongue on the other hand, said tongue being wrapped around the integral hinge pin in order to connect the rims hingedly together.

It will be seen that an effective and efficient method of forming a hinge between jewelry item rims is provided, and this is particularly applicable to the production of lockets.

The rim blanks preferably are produced from sheet material by high precision manufacturing machines, which typically will be high precision stamping machines, and the rims may be produced in the metal which traditionally is used for lockets. This metal may obviously range from precious metal such as gold to inexpensive metallic alloy.

One of the said rims may also be provided with an integral clasp tongue which is subsequently bent in the manufacturing operation so as to grip the other rim and form a spring clasp for the item of jewelry. The integral hinge tongue and clasp tongue may be provided on the same rim.

Finally, each of the rims may be provided with a chamfer or cut out on an edge thereof so that when the rims are in the closed position, the respective cut outs are adjacent and define a fingernail receiving cavity to enable a fingernail to be forced between the rims to open same against the holding effect of the clasp.

When the invention is applied to a locket, the said rims preferably are soldered to respective and conventional locket shells.

The rim provided with the integral hinge pin may also be provided with an integral attachment loop for the connection to the locket of a jewelry chain.

To assemble a locket in accordance with the present invention, the rims respectively are attached to the shells in register therewith, by the conventional method of soldering, and the integral tongue on the other rim to be passed behind the hinge pin between the hinge pin and the shell, following which the tongue is wrapped round the hinge pin by simple bending of same, manually, so that the bent tongue forms a hinge sleeve. The integral clasp tongue is bent to form its clamping function during the manufacture of the rim, of which its clasp tongue is part.

It should be noted that in order to facilitate assembly and assist registration of the shell and to provide for quality manufacture, the integral hinge pin may be offset relative to the rim and formed between a pair of shoulders defined in the appropriate rim so that the integral hinge tongue is limited in its axially movement lengthwise of the hinge pin, and also that at the other side of the rim is-formed a recess again between shoulders for the receipt of the clasp tongue. With these constraining shoulders, when the locket is moved to the closed position, the respective shells will be in accurate register providing a high quality manufacturing characteristic to the finished product.

The exterior surfaces of the shells may be embossed and/or decorated in any desired manner, or as with many traditional lockets, may be left plain.

Embodiments of the invention will now be described, by comparison with the manufacture of a known locket, with reference to the accompanying drawings, wherein.

Figure 2:
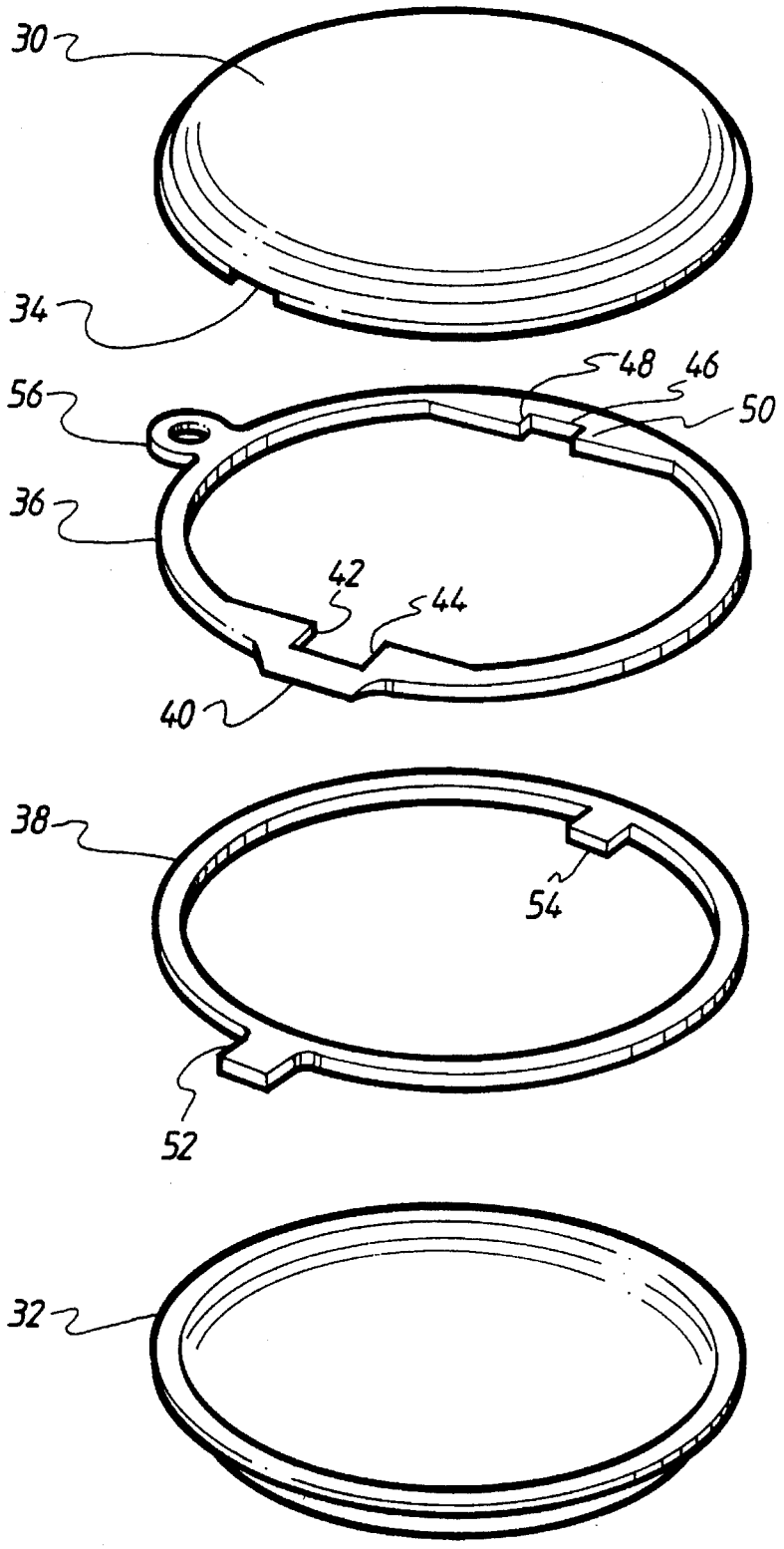
FIG. 2 is a view similar to FIG. 1, but showing the components of a locket according to an embodiment of the invention.
Figure 4:
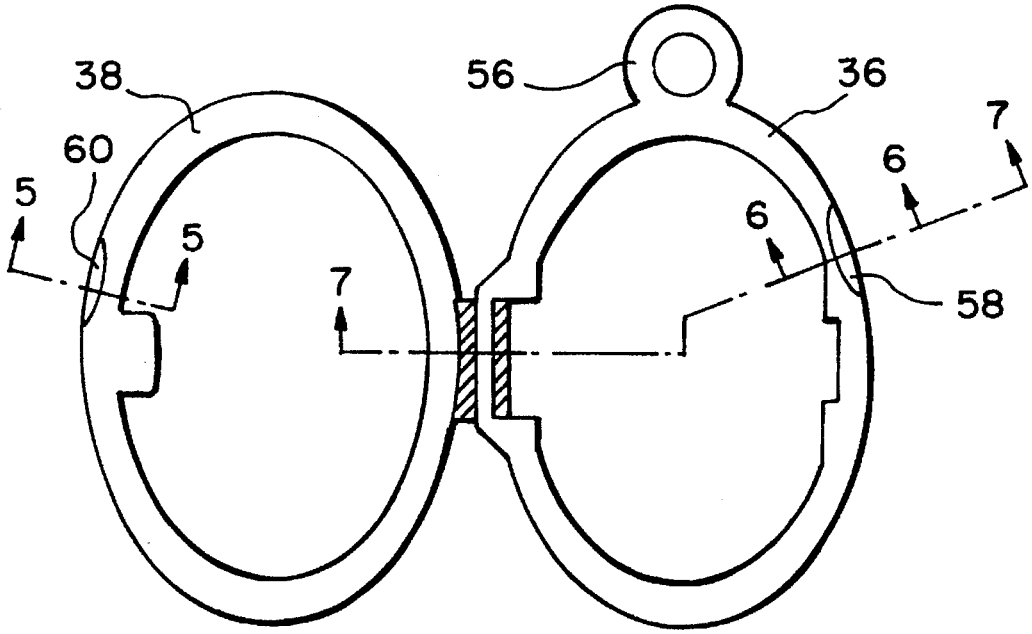
Figure 5:
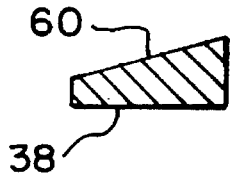
Figure 6:
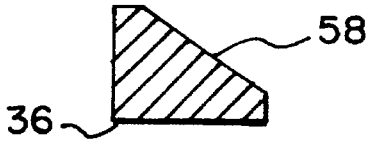
Figure 7:
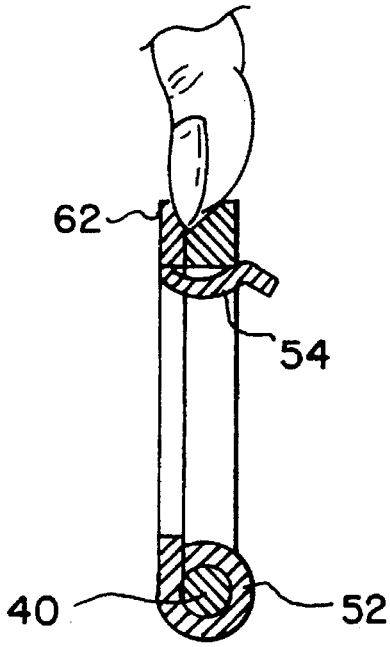

FIGS. 3A to 3D comprise a series of perspective views showing how the hinge between the rims shown in FIG. 2 is formed;

FIG. 4 is a plan view showing the rims of FIG. 2 when hinged together and in the open position;

FIGS. 5 and 6 are detailed sectional views taken on the lines 1—1 and 2—2 in FIG. 4; and FIG. 7 is a sectional elevation of the rims of FIG. 4 when in the closed position, and taken on the section line 3—3 in FIG. 4; and FIG. 8 is a plan view showing the rims of a locket according to a further embodiment of the invention.

Figure 1:
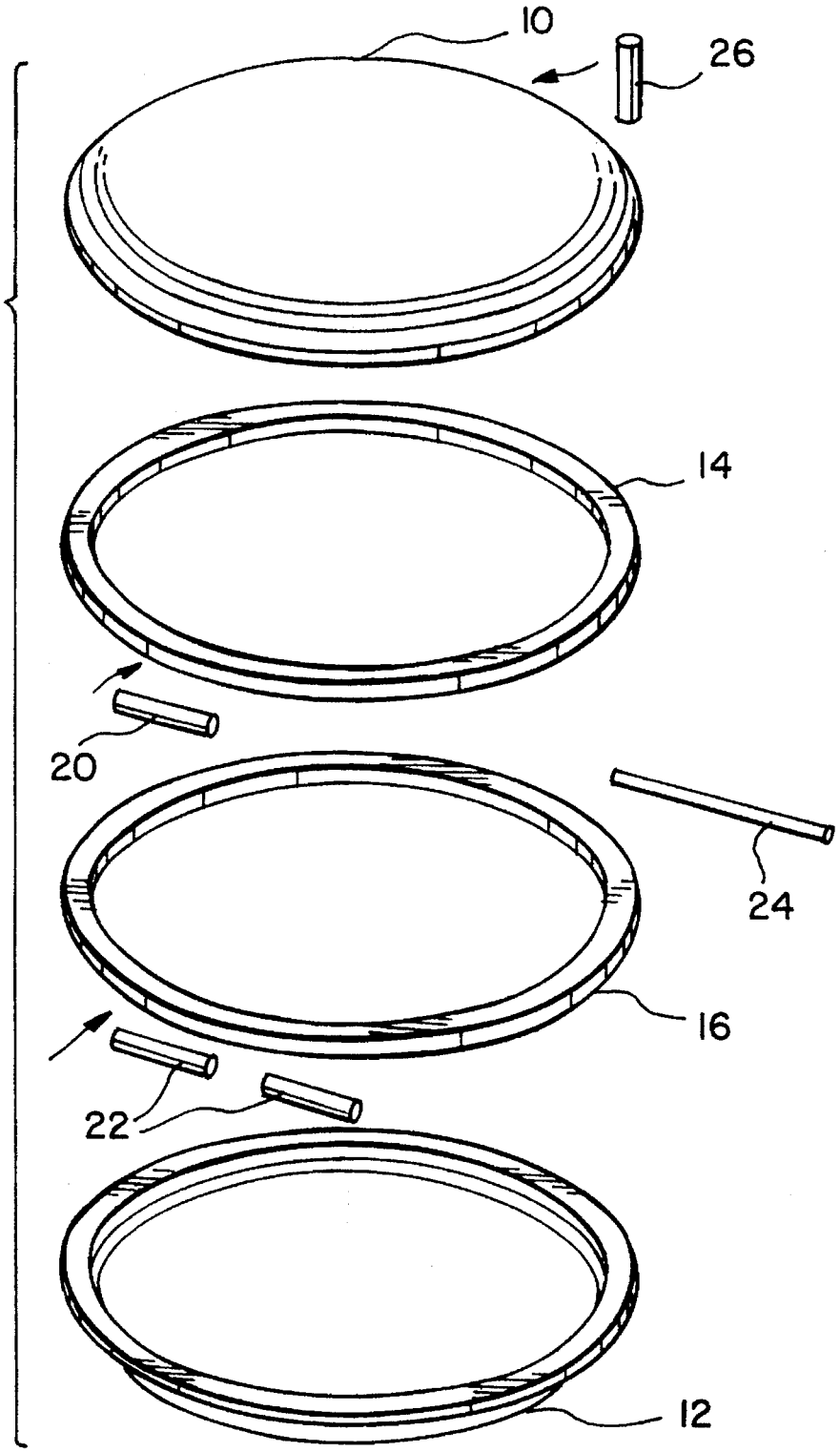
FIG. 1 PRIOR ART
FIG. 1 is an exploded perspective view of the components of a locket according to the prior art.

Referring to the drawings, in FIG. 1, the components of a conventional locket are shown, and will be seen to comprise a pair of dished shells 10 and 12 of essentially similar configuration. The shells in this example are elliptical, but they could be of any appropriate shape.

Additionally, the locket includes a pair of rings 14 and 16 which in use are soldered to the edges of the shells 10 and 12, the rings being of the same size of the shells 10 and 12.

The thus connected rims and shells form the locket halves, and the halves are hinged together by a hinge assembly created by the connection of hinge sleeve 20 (connected to locket half 10, 14) and hinge sleeves 22 (connected to locket half 12, 16). To form the hinge the sleeves 20 and 22 are aligned, and a hinge pin 24 is inserted in the aligned sleeves to complete the hinge connection of the locket halves.

Finally, a locket clasp 26 is soldered to the locket half 10, 14 and clasp 26 is adapted to engage an appropriate formation on the locket half 12, 16 to keep the locket in closed condition.

Although not shown in FIG. 1, the rims 14 and 16 may be chamfered or cut away in order to provide a thumb nail or finger nail slot in which a nail can be inserted in order to open the locket against the retaining force of the clasp 26. Also, one of the rims 14 and 26 may be provided with an attachment ring by which the locket may be suspended from the users neck by a conventional locket chain.

The problem with the locket assembly of FIG. 1 is that it includes many parts which have to be carefully connected together if a locket of quality is to result. Its manufacture is therefore time consuming and relatively costly, and the present invention seeks to provide a locket which can be manufactured quicker and less expensively than the conventional locket and an example of the locket according to the present invention is shown in FIGS. 2 to 7.

Referring to FIG. 2 which illustrates the components of the locket according to an embodiment of the invention in exploded perspective view, again the locket is provided with a pair of similar shells 30 and 32, the shell 30 however having a cut out 34 for a purpose to be explained.

The locket also has a pair of endless rings or rims 36 and 38 but these rims are formed as stampings and are produced by high precision manufacturing machinery, so that the rims 36 and 38 have extra formations avoiding the need to attach separate hinge sleeves and pins as described in relation to the FIG. 1 arrangement.

In the case of rim 36 which is for attachment to shell 30 by soldering, the rim has an integral hinge pin 40 formed as an integral part of the rim between a pair of limiting shoulders 42 and 44, and subsequently machined or hand ground or filed to circular cross section opposite the hinge pin 40 the rim furthermore has a recess 46 which is defined by a pair of limiting shoulders 48 and 50. The hinge pin 40 is offset relative to the elliptical line of the rim to enhance assembly as will be described.

As regards the rim 38, this is provided with an integral hinge tongue 52, and diametrically opposite same an integral clasp tongue 54 which is slightly shorter and narrower than the tongue 52.

The rim 38 is as conventional soldered to the shell 32.

Also shown in FIG. 2 is that the rim 36 is provided with an attachment loop 56 for connection of the locket to a conventional locket chain.

In the manufacture of the locket of FIG. 2, the rims 36 and 38 are soldered to the shells 30 and 32 in conventional fashion but with the cut out 34 of shell 30 in register with the pin 40 and then the resulting locket halves are connected as shown sequentially in FIGS. 3A to 3D.

Figure 3A:
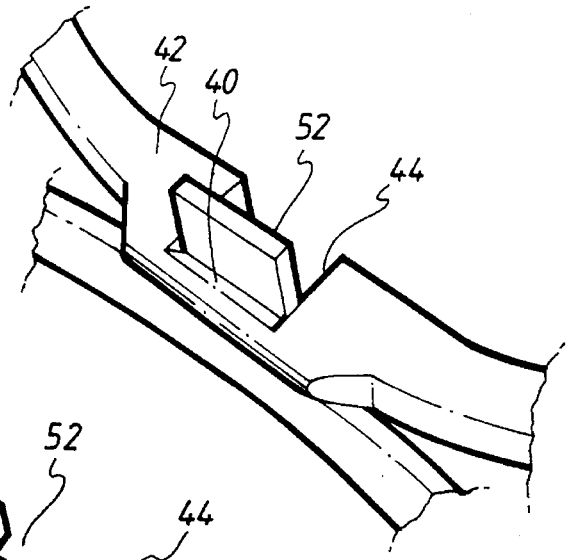

The locket halves are brought together in the open condition so that the tongue 52 is passed under the hinge pin 40 between the shoulders of 42 and 44 as shown in FIG. 3A, the cut out 34 providing clearance for this purpose and the offset of the hinge rim 40 also enabling the tongue 52 to be passed between the pin 40 and the shell 30.

Figure 3B:
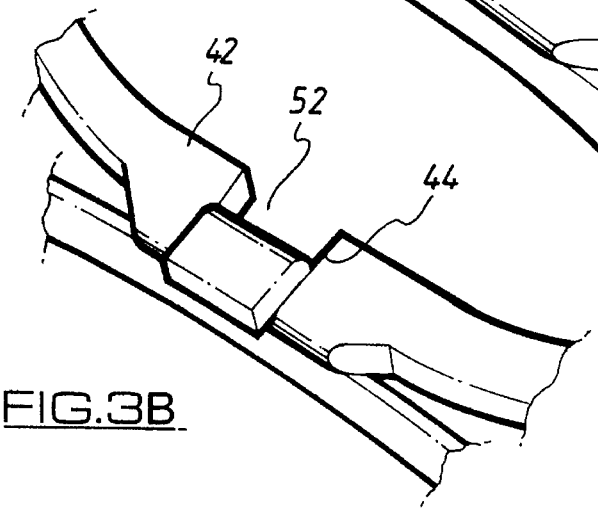
Figure 3C:
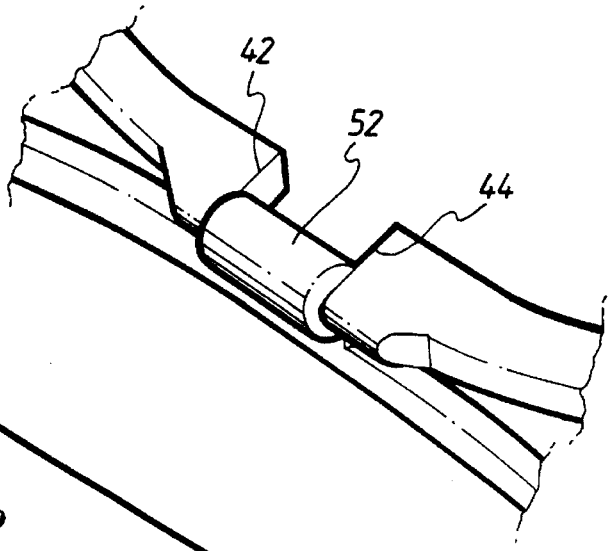
Figure 3D:
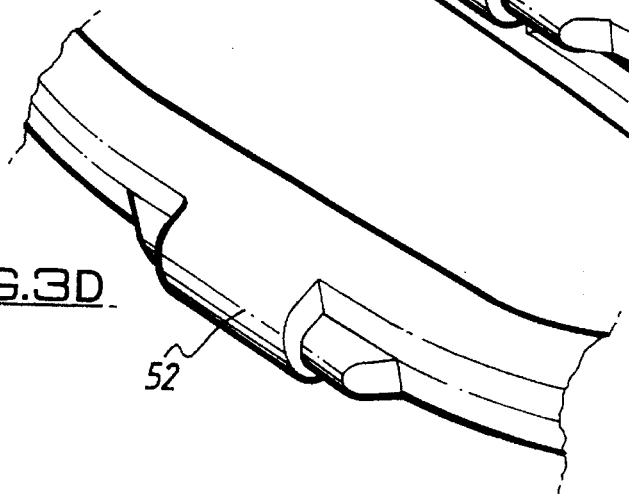

To connect the locket halves, the tongue 52 is simply bent sequentially as shown in FIGS. 3B and 3C until in fact the tongue 52 forms a hinge sleeve around the hinge pin 40 and the two halves therefore become hingedly interconnected. The bending of the tongue 52 can be done readily by relatively unskilled labour using a suitable tool or tools. It will be appreciated that the tongue 52 will be made of the appropriate length, and the hinge pin 40 will be appropriately dimensioned and positioned so that the two locket halves can readily hinge between the open and closed positions. FIG. 3D in fact shows the locket rims when the locket is in the closed position. The shoulders 42 and 44 limit the extent to which the tongue 52 (having the form of a hinge sleeve) can move axially of the pin 40, and of course the accuracy of the manufacturing technique and the limitation of the tolerances is directly related to the quality of manufacture of the resulting locket.

The clasp tongue 54 is bent as shown in fact in FIG. 7 in order to form a spring clasp which engages in the recess 46 in the closed position of the locket holding the locket halves together. Again the shoulders 48 and 50 provide a means for restraining lateral movement of the locket halves in the closed position.

FIG. 4 shows that the rims 36 and 38 are recessed or scalloped at locations 58 and 60 to provide fingernail recesses. These scallop portions come together as shown in FIG. 7 to provide a cavity 62 in which the fingernail can be located in order to force the locket halves appart against the spring action of the clasp tongue 54.

FIGS. 5 and 6 show that the rim 36 is in fact of heavier gauge metal than the rim 38, although this is not necessary to the invention.

It will be understood that the invention therefore provides in an item of jewelry, and in particular in a locket, a particularly effective manufacturing arrangment which is simpler than the known method of manufacture, resulting in a less expensive product without sacrificing the manufacturing accuracy and product quality.

The hinge pin 40, the shoulders 42 and 44, the attachment loop 56 and the recess 46 are all formed during the pressing operations of rim 36, and in the case of rim 38, the clasp tongue 54 may be simultaneously formed into the catch configuration shown in FIG. 7 so that the only subsequent operation to be performed is that of bending the tongue 52 as shown in FIGS. 3A to 3C.

Some refining features are incorporated in the rims of an embodiment shown in FIG. 8. These features may be included to eliminate sharp edges and protrusions on the inner edges 65 and 67 of the rims 64 and 66 respectively.

One feature is that cuts 76 and 78 are provided in the rim 64 and at each side of the catch tongue 54. When the tongue 54 is bent to form the clasp, one surface will lie in register with the inner edge 65, rather than protrude therefrom.

Edge portions 68 and 72 constitute further refining features on rim 66 and serve to ensure a continuous inner edge 67. Edge portion 68 extends between the shoulders 42 and 44 to define a rectangular hinge aperture 70, while edge portion 72 similarly defines a rectangular clasp aperture 74.

In this embodiment, the hinge tongue 52 is inserted into a rectangular aperture 70 before being wrapped around the hinge pin 40 to form a hinge, and the clasp tongue 54 engages inside a clasp aperture 74 to close the completed locket.

The features of the rims ensure a very good match of the rims and the rims can be of any required shape dictated by the nature of the product to be made or the contents to be held. Additionally, although the shells and rims are shown as being of the same shape in the examples described, it will be appreciated that this is not strictly necessary although the rim would may have to be varied if it is to accommodate a shell of a different configuration.

I claim:

1. An item of jewelry comprising:

(a) first and second blanks in the form of endless rims, and defining thereby respective first and second endless rims;

(b) means on said first endless rim defining over a length of said first endless rim, an integral hinge pin; and (c) an integral tongue on said second endless rim which wraps around the said length of said first endless rim, said means on said first endless rim being a part of the rim itself whereby said endless rims are connected hingedly together without the need for a separate pintle pin or an additional hinge wire.

2. An item of jewelry according to claim 1, characterized in that the rim blanks are produced from sheet material by high precision manufacturing machines, typically high precision stamping machines.

3. An item of jewelry according to either of claims 1 or 2, characterized in that one of said rims also is provided with an integral clamp tongue which is subsequently bent in the manufacturing operation so as to grip the other rim and form a spring clasp for the item of jewelry.

4. An item of jewelry according to claim 3, characterized in that the integral hinge tongue and the clamp tongue are on the same rim.

5. An item of jewelry according to claim 3, characterized in that each of the rims is provided with a chamfer or cut out on the edge thereof so that when the rims are in the closed position, the respective cut outs are adjacent and define a fingernail receiving cavity to enable a fingernail to be forced between the rims to open them against the grip of the clasp.

6. An item of jewelry according to either of claims 1 or 2, characterized in that the item is a locket and the said rims are soldered to respective and conventional locket shells.

7. An item of jewelry according to either of claims 1 or 2, characterized in that the rim provided with the integral hinge pin is also provided with an integral attachment loop for the connection to the item of a jewelry chain.

8. An item of jewelry according to either of claims 1 or 2, characterized in that the integral hinge pin is offset relative to the rim of which it is a part.

9. An item of jewelry according to claim 8, characterized in that the hinge pin is formed between a pair of shoulders (44) defined in the rim limiting axial movement of the tongue lengthwise of the pin (40).

10. An item of jewelry according to either of claims 1 or 2, characterized by a recess on one of the rims for receipt of a clamp tongue on the other rim, said recess being bounded by shoulders.

* * * * *